United States Patent [19]

Ben-Dov

[11] Patent Number: 4,885,839

[45] Date of Patent: Dec. 12, 1989

[54] PROCESS OF FABRICATING A WAVEGUIDE

[75] Inventor: Oded Ben-Dov, Burlington County, N.J.

[73] Assignee: General Signal Corporation, Stamford, Conn.

[21] Appl. No.: 23,991

[22] Filed: Mar. 10, 1987

Related U.S. Application Data

[60] Division of Ser. No. 799,857, Nov. 20, 1985, abandoned, which is a continuation-in-part of Ser. No. 739,427, May 29, 1985, Pat. No. 4,654,962.

[51] Int. Cl.[4] ..... H01P 11/00

[52] U.S. Cl. ..... 29/600; 333/239

[58] Field of Search ..... 29/600, 416; 333/26, 333/239, 242; 343/840; 138/116, 115

[56] References Cited

U.S. PATENT DOCUMENTS

| | | | |
|---|---|---|---|
| 2,783,440 | 2/1957 | Lovick, Jr. | 333/239 |
| 3,205,462 | 9/1965 | Meinke | 333/239 |
| 4,549,310 | 10/1985 | Woodward | 455/129 |
| 4,556,853 | 12/1985 | Clark | 333/26 |

FOREIGN PATENT DOCUMENTS

| | | | |
|---|---|---|---|
| 732423 | 3/1943 | Fed. Rep. of Germany | 333/242 |
| 2718684 | 11/1978 | Fed. Rep. of Germany | 343/890 |

OTHER PUBLICATIONS

Article "Cutoff Wavelengths of Waveguides with Unusual Cross Sections", by Pyle et al., published at pp. 556–557 of IEEE Transactions on Microwave Theory and Techniques, Sep. 1964.

*Primary Examiner*—Howard N. Goldberg
*Assistant Examiner*—Carl J. Arbes
*Attorney, Agent, or Firm*—Robert R. Hubbard; John Ohlandt

[57] ABSTRACT

A broadcasting arrangement includes a source of signals to be transmitted which is subject to distortion in the event that signals are reflected. An antenna is adapted for radiating all the signal applied to a polarization sensitive input part with a particular polarization. The antenna is mounted on a tower. A waveguide is coupled to the source of signals and to the input port of the antenna. If the waveguide is circular waveguide, the windload on the tower due to wind loading of the circular waveguide is low, but flexure which occurs results in polarization changes which causes signals applied to the antenna input port to be reflected, thereby reducing radiated power and causing distortion. If the waveguide is rectangular, the wind loading is high and the tower must be more sturdy and therefore more costly than for circualr waveguide. A truncated circular waveguide is used which has a wave propagation channel defined by a cylinder and a pair of parallel longitudinal plates in the cylinder. Truncated circular waveguide has low wind load and polarization stability.

3 Claims, 8 Drawing Sheets

PROCESS OF FABRICATING A WAVEGUIDE

This application is a division of U.S. patent application, Ser. No. 799,857, filed Nov. 20, 1985, now abandoned, which was a continuation-in-part of U.S. patent application, Ser. No. 739,427, filed May 29, 1985, now U.S. Pat. No. 4,654,962.

FIELD OF THE INVENTION

The present invention relates to a broadcast system including a tower, an antenna mounted on the tower, and a waveguide structure having a low windload exterior portion and an interior portion having a relatively wide bandwidth and resistance to cross polarization changes due to stress or flexure.

BACKGROUND OF THE INVENTION

In order to transmit maximum allowable power, broadcast antennas should be placed at the highest possible location, as for example, on top of a hill or a tower. Such towers may be up to 2,000 feet in height in order to give the best line-of-sight to distant viewers. The transmitter which produces the high-power broadcast signal is a large structure and is necessarily located on the ground. The high-power signal must be carried from the transmitter up the tower to the feed point at the base of the antenna. VHF (54–88 MHz and 174–216 MHz) and UHF (470–890 MHz) broadcast television signals are ordinarily carried by transmission lines, which are signal conductors designed to minimize signal losses between a source and a load. At UHF frequencies, waveguides are used for carrying the signal from the transmitter to the antenna since a waveguide is particularly well suited to handle the relatively high-power signals associated with television broadcasting with a minimum of signal attenuation.

At present, for high power UHF-TV applications there are only two types of waveguides to choose from, i.e., either hollow circular waveguide or rectangular waveguide. Rectangular waveguide is advantageous since it offers a relatively wide bandwidth for the dominant mode of signal propagation and substantially no propagation of the cross-polarized dominant modes. Thus, video signal distortion due to the appearance of cross-polarized modes is minimal. However, due to the flat exterior sides of rectangular waveguide, very high lateral forces are presented to the antenna tower due to windloading, thereby requiring a more sturdy, and therefore more costly, antenna tower.

On the other hand, hollow circular waveguide has an exterior which is optimum for minimizing the effect of windloading on the antenna tower. However, unavoidable flexing and asymmetries in circular waveguide due to windloading on the waveguide itself lead to the generation of undesirable cross-polarized mode propagation and resulting video signal distortion. Cross-polarized modes effectively swing the principal plane of polarization, i.e., the dominant mode of the electromagnetic energy propagating through the waveguide, from the desired plane to a plane intermediate the desired plane and the plane of the cross-polarized mode. If an electric probe or magnetic loop is used for coupling energy from the end of the waveguide to the antenna, rotation of the polarization plane results in reduction of the power available to the antenna and also results in reflection of the remainder of the power back to the transmitter. The latter can result in undesirable picture distortion.

Thus, a broadcast system is needed in which an antenna on a tower is fed by a waveguide which has relatively low windloading while displaying stable polarization characteristics under conditions of stress and flexure.

SUMMARY OF THE INVENTION

A broadcast system includes a tower and an antenna on the tower. A waveguide carries signals to be broadcast from a feed at the bottom of the tower to the antenna feed point. In order to reduce wind loading effects attributable to the waveguide while providing stable transmission characteristics, the waveguide has a circular exterior cross section, and interior dimensions established by a pair of parallel conductive flat walls spaced apart by a pair of conductive arcuate walls.

BRIEF DESCRIPTION OF THE DRAWING

FIG. 10 illustrates in cross sectional view the use of the shrouded portion of the arrangement of FIG. 9 for ducting conductors for tower lighting, maintenance communication, antenna deicer heating and the like.

DETAILED DESCRIPTION OF THE INVENTION

Figure 1:
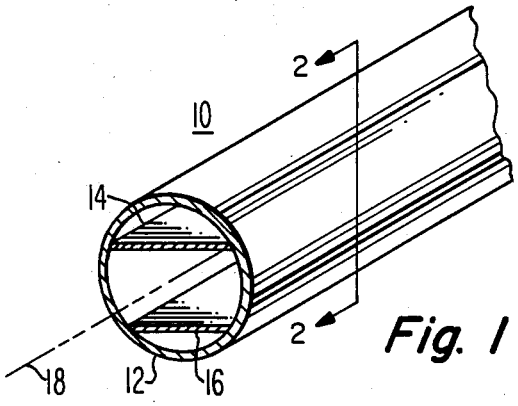
FIG. 1 illustrates a perspective view of a waveguide according to an aspect of the present invention.
Figure 2A:
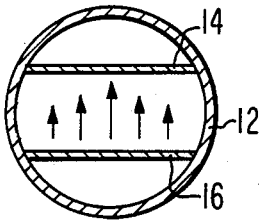
FIG. 2*a* illustrates a cross section view of the waveguide of FIG. 1, showing the instantaneous direction of the electric field.
Figure 6:
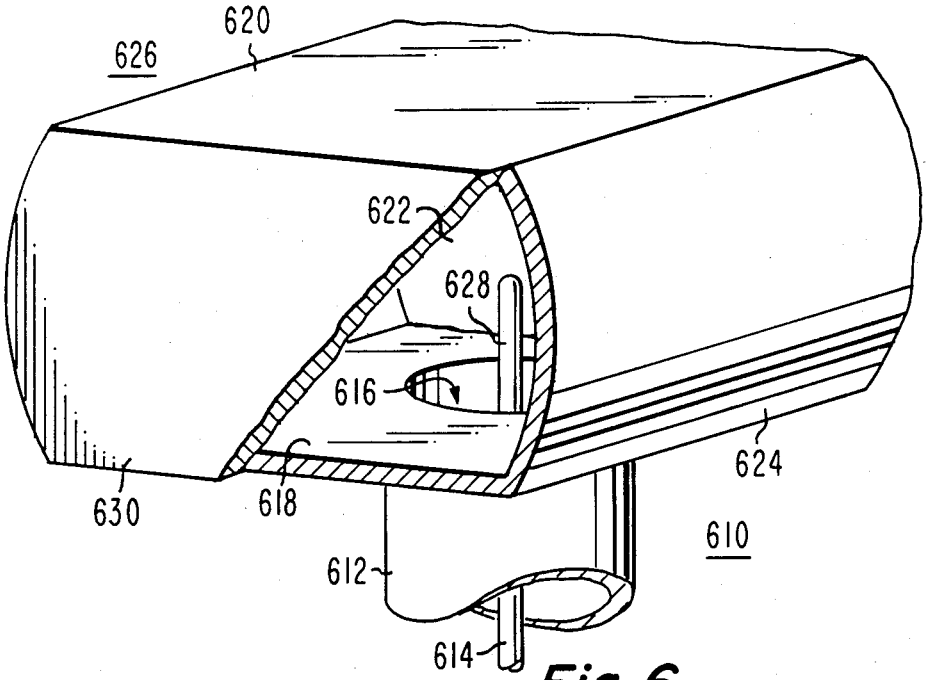
FIG. 6 is a perspective view, partially cut away, of a coax-to-truncated circular-waveguide transition which may be used in the arrangement of FIG. 5.
Figure 7B:
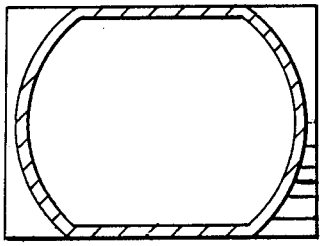
FIG. 7*b* is a sectional view thereof.
Figure 7A:
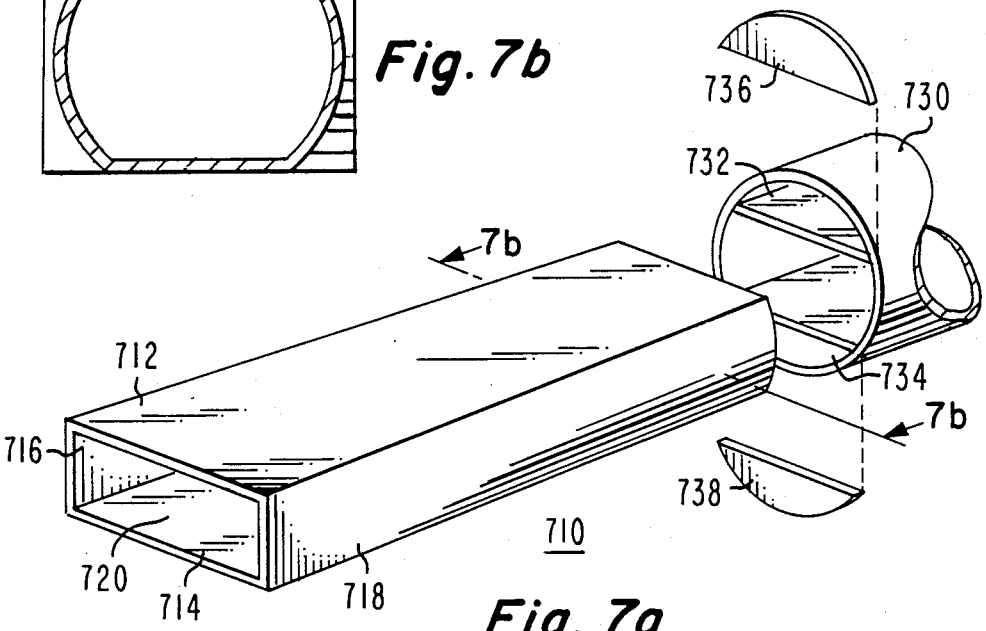
FIG. 7*a* is an exploded perspective view of a tapered transition from rectangular waveguide to truncated circular waveguide which may be used in the arrangement of FIG. 5.

As illustrated in FIG. 1, a waveguide 10 comprises as its exterior portion a hollow, elongated cylinder 12 and includes elongated flat plates 14 and 16 disposed symmetrically about a central axis 18 of cylinder 12. For propagating signal energy within waveguide 10, at least plates 14 and 16 and the arcuate portions of cylinder 12 located between plates 14 and 16 must be electrically conductive. Therefore, signal propagation is confined within the conductive area bounded by and including plates 14 and 16 and, as illustrated by arrows in the FIG. 2*a* cross-section view, readily supports a dominant mode similar to the $TE_{10}$ mode propagated in rectangular waveguide. The arrows illustrate the polarization or lateral direction of the electric field in the dominant mode. Signals can be coupled into or from the signal propagating portion of the waveguide using conventional electric probe or magnetic loop techniques. An electric probe is illustrated in FIG. 6.

Figure 2B:
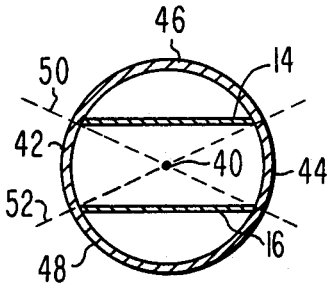
FIG. 2*b* illustrates centers of curvature and subtended portions of the outer wall.

FIG. 2*b* is a cross section of truncated circular waveguide. As illustrated in FIG. 2*b*, the center of curvature of cylinder 12 is at a point 40. Dotted radial line 50 and 52 passing through center 40 and the junctions which plates 14 and 16 make with cylinder 12 divide cylinder 12 into arcuate wall portions 42, 44, 46 and 48. Plate 14 subtends an angle encompassing wall portion 46, and plate 16 subtends an angle encompassing wall portion 48. Wall portions 42 and 44 are not subtended by either plate.

As previously noted, dominannt mode signal propagation of rectangular waveguide is preferred for television broadcasting due to its durability in maintaining its dominannt polarization mode throughout its length. This durability results in reduced signal distortions and a maximization of the coupling of signal energy to the antenna. Since the exterior of waveguide 10 has a circular cross section, its windloading on the antenna tower is minimized, allowing the use of a less costly tower. Furthermore, the windload on the waveguide itself is symmetrical, and waveguide flexing is reduced. Furthermore, signal distortions which result from waveguide flexing are also minimized due to the reduced windloading and to the stable dominant mode propagation characteristic of the interior cross section.

In summary, waveguide structure 10 has a circular exterior cross section which minimizes windloading and a doubly-truncated circular interior cross section which propagates signal energy in a manner similar to rectangular waveguide. This stability prevents the shifts in polarization which result in reflections and distortion when simple circular waveguide is stressed and flexed by unavoidable tower movement due to wind.

Figure 3A:
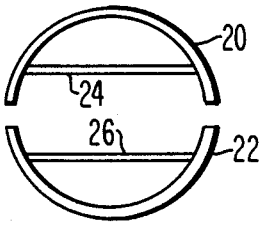
FIGS. 3*a* and 3*b* illustrate two methods for manufacturing the waveguide of FIG. 1.

FIG. 3*a* illustrates a cross-section view of one method of manufacturing the waveguide of FIG. 1. The starting material is a elongated conductive circular cylinder longitudinally cut in half to form two half-circular portions 20 and 22. Equal width elongated flat conductive plates 24 and 26 are conductively attached along their elongated edges to the interior of respective ones of half-circular portions 20 and 22. The two portions 20 and 22 are then conductively joined along their peripheral edges for completing the waveguide structure. The conductive attachment can typically be by welding.

Figure 3B:
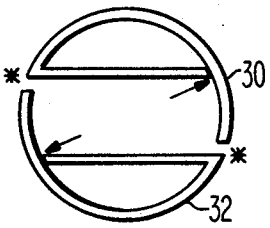

FIG. 3*b* illustrates an alternative manufacturing technique wherein the number of required weld areas is reduced to four. In this technique, two elongated flat conductive plates are bent into identical waveguide portions having cross sections illustrated as 30 and 32, respectively. Each portion has one end welded along a line, indicated by the arrows, to its interior wall. Portions 30 and 32 are then welded together along a line, indicated by the asterisks, for completing the novel waveguide structure.

Figure 4A:
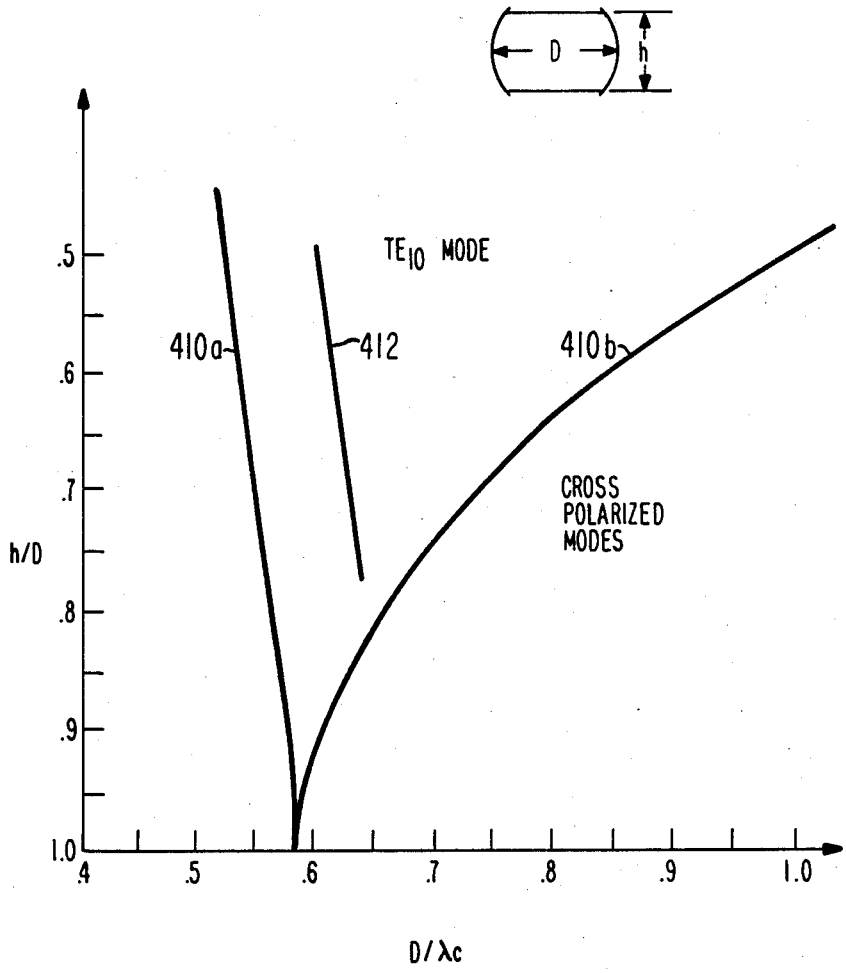
FIGS. 4*a*, 4*b* and 4*c* illustrate graphs useful for designing waveguide according to the invention.
Figure 4B:
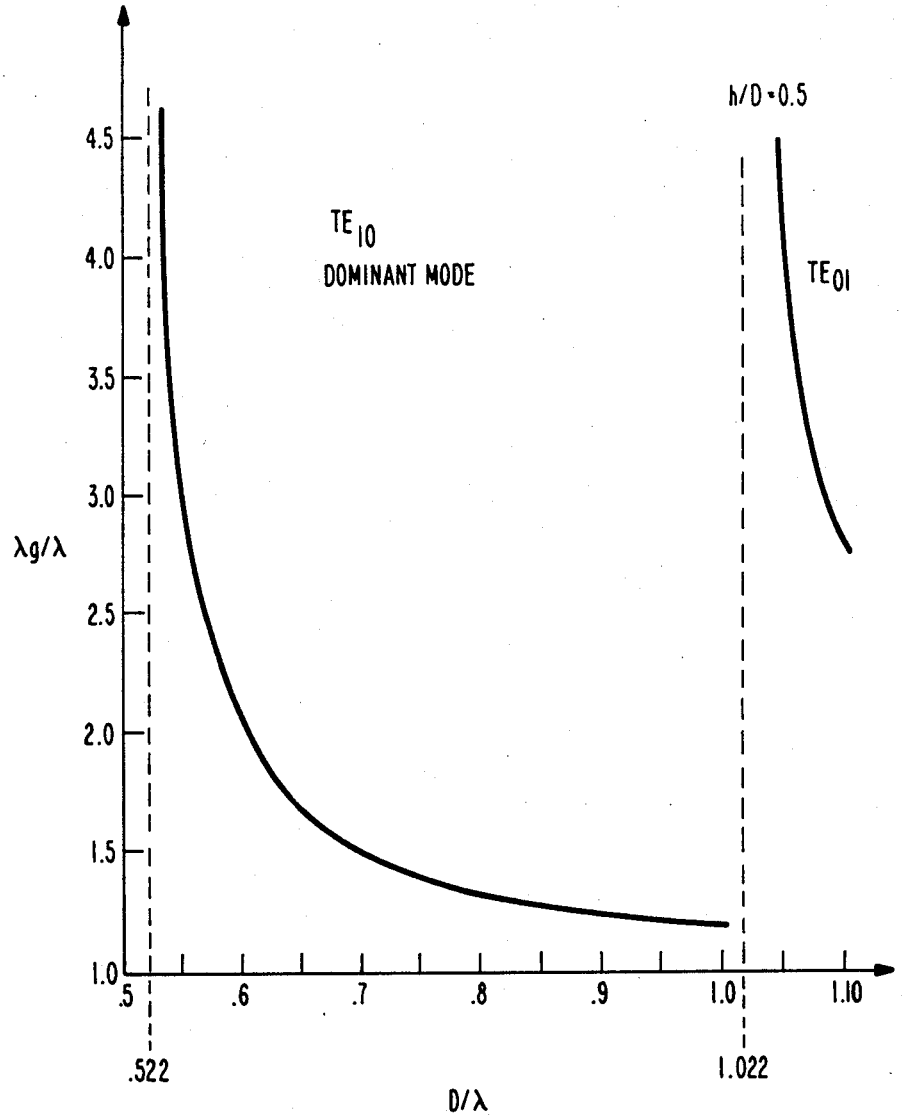
Figure 4C:
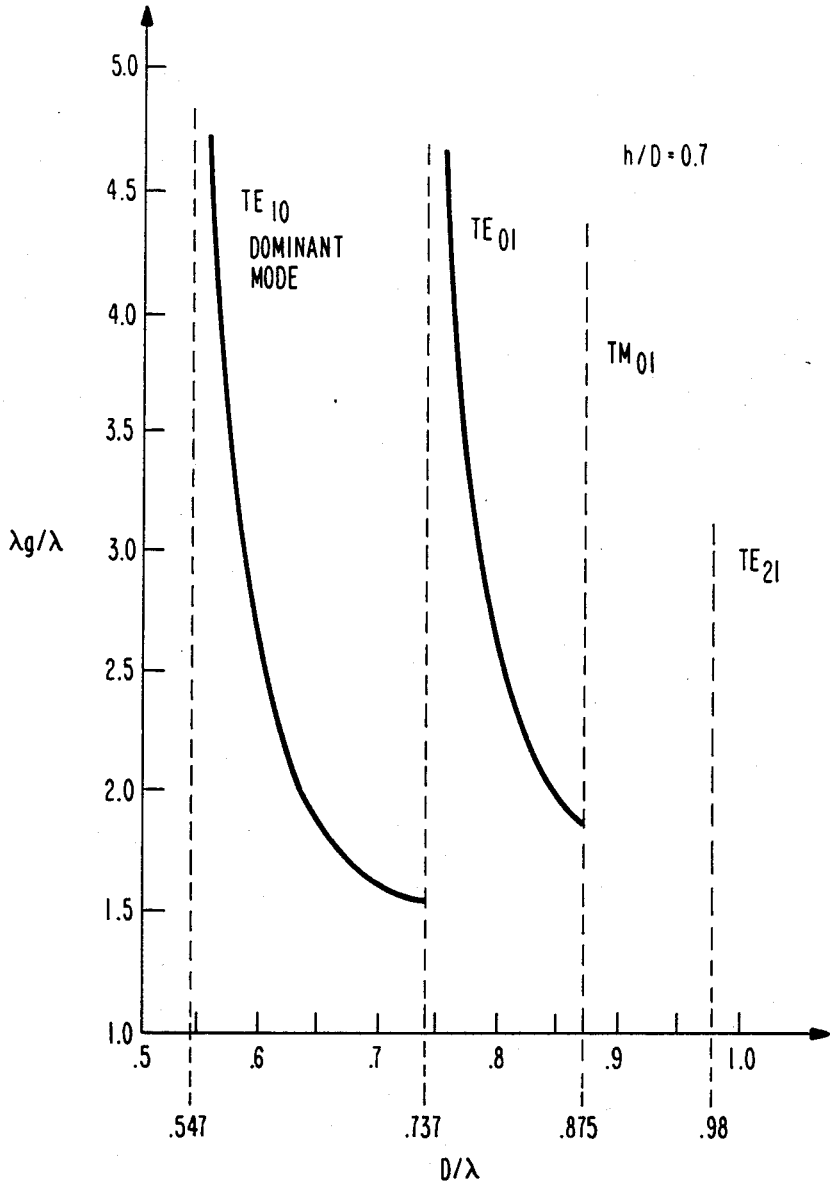

FIGS. 4*a*, 4*b* and 4*c* were determined experimentally and provide design information concerning bandwidth, attenuation and elimination of unwanted propagation modes.

The graph of FIG. 4*a* has as its ordinate the factor h/D, which is the ratio of the distance (h) between plates 14 and 16 of FIG. 1 and the interior diameter (D) of the circular cross section, and as its absissa the factor $D/\lambda_c$, which is the ratio of the diameter (D) and the cutoff wavelength $\lambda_c$. The area between left branch 410*a* and right branch 410*b* of a curve 410 represents the possible combinations of factors h/D and $D/\lambda_c$ which result in a dominant $TE_{10}$ mode of transmission through the double-truncated waveguide of the invention. As would be expected, the left branch 410*a* of curve 410 asymptotically approaches the 0.5 value for the factor $D/\lambda_c$ which is the cutoff wavelength of the $TE_{10}$ mode for rectangular waveguide. The area to the right of right branch 410*b* of curve 410 represents those combinations of these factors which result in cross-polarized modes being propagated in the waveguide. Line 412 illustrates a locus of parameters providing a relative phase velocity of 2.0 within the waveguide. It is desirable to keep the relative phase velocity less than 2.0 (i.e., to the right of line 412) in order to reduce impedance value variation with frequency within the waveguide.

FIGS. 4*b* and 4*c* illustrate the variation of the factor $D/\lambda$ versus the wavelength factor $\lambda_g/\lambda$, for h/D factors of 0.5 and 0.7, respectively. As shown for $h/D=0.5$ in FIG. 4*b*, the dominant $TE_{10}$ mode is propagated between $D/\lambda$ values of 0.522 and 1.022. Cross-polarized modes are propagated for $D/\lambda$ greater than 1.022. As shown in FIG. 4*c* for $h/D=0.7$, the dominant $TE_{10}$ mode is propagated between $D/\lambda$ values of 0.547 and 0.737. Cross-polarized modes are propagated for $D/\lambda$ values greater than 0.737. For best results, the designer should stay at least 15% away from the cutoff wavelength when deciding on a $D/\lambda$ value.

Although a preferred embodiment of the waveguide aspect of the present invention has been illustrated, other embodiments are possible. For example, instead of a smooth circular exterior for the waveguide, an exterior having a cross section with a piecewise approximation to a circle, such as an octagonal cross section, could be used. The octagonal exterior would still have a significant advantage over rectangular waveguide with respect to minimizing windload. A waveguide structure embodying the invention could be constructed by placing a waveguide comprising flat plates 14 and 16 (FIG. 2*b*) and arcuate portions 42 and 44 in a round pipe. This would result in about a 10% smaller pipe diameter than if a rectangular waveguide designed for the same frequence was placed inside a round pipe, due to the curved sidewalls of the inventive waveguide. The smaller diameter pipe would result in a reduced cost of materials and lower windloading. Further, the conductive portions of the waveguide can be manufactured by extrusion.

Figure 5:
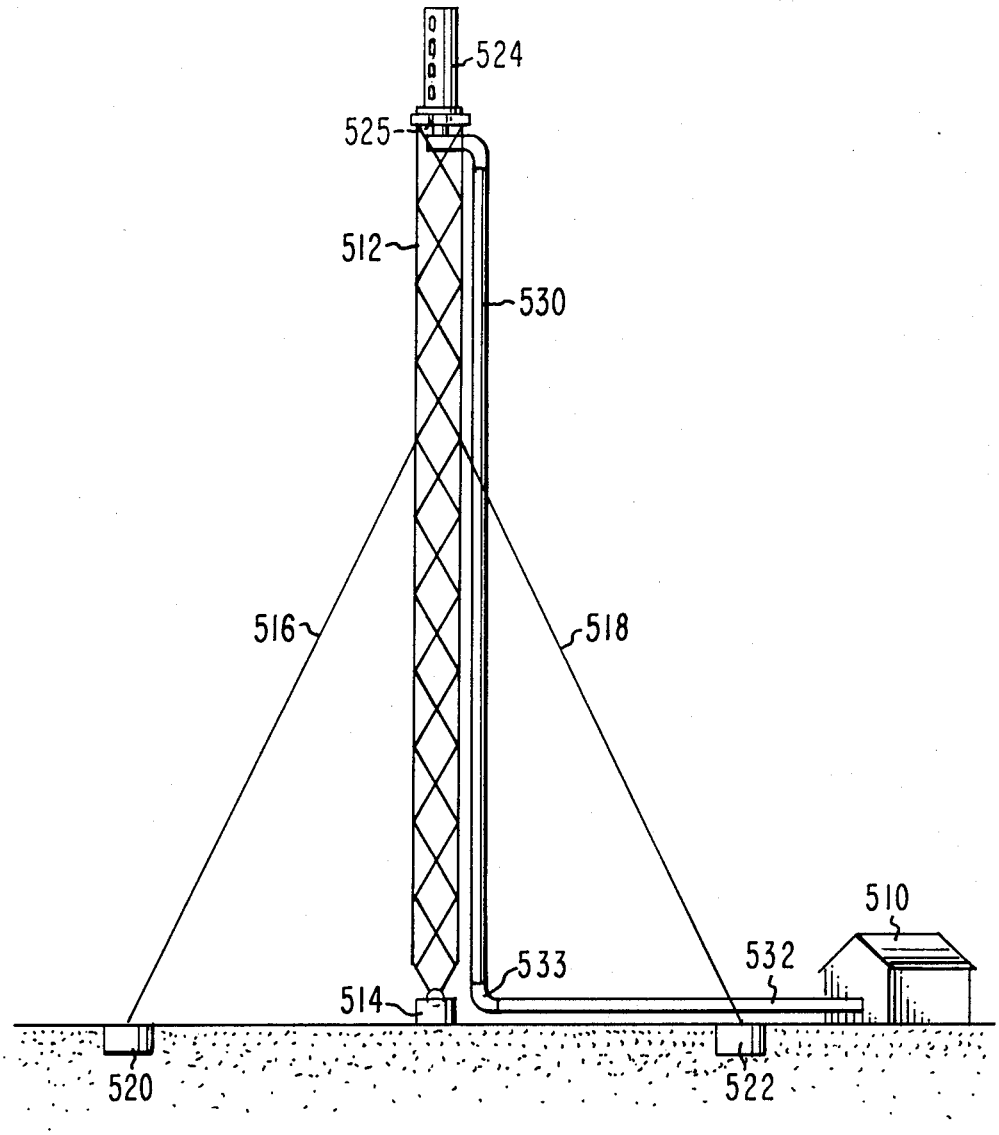
FIG. 5 illustrates in elevation view a broadcast system including a tower, an antenna mounted thereupon, and a waveguide of the type described in conjunction with FIGS. 1–4 carrying signals from the base of the tower to the antenna feed point.

FIG. 5 illustrates a broadcasting system according to the invention. In FIG. 5, a source (not illustrated) of signals to be broadcast is housed in a building 510. A tower 512 is pivotally mounted on a base 514 and supported by guy wires, two of which are illustrated as 516 and 518, which are connected to a point on the tower and to ground anchors 520 and 522, respectively. An antenna 524 is mounted atop tower 512. Antenna 524 is of the slotted cylinder type known as a "pylon" which is rugged and provides low wind resistance. Signals are coupled to an input port 525 at the bottom of antenna 524 by a transmission line including a portion 530 extending from input port 525 of antenna 524 to the base of the tower and a further portion 523 extending from the base of tower 512 to the signal source in building 510, with a bend 533 at the base of the tower.

Pylon antenna 524 is often a coaxial antenna or is provided with a coaxial transmission line feed. A coaxial transmission line (coax) as well known in the art includes a cylindrical outer conductor and a center conductor coaxial with the outer conductor. Coaxial transmission line is not ordinarily used for long runs at high frequencies, such as for section 530 extending the full length of tower 512, because of the relatively high signal attenuation of coaxial transmission line. Circular waveguide has lower loss than coaxial cable, but requires a waveguide-to-coax transition for coupling to the radiating portions of antenna 524. That is, if antenna 524 is coax fed, a circular-waveguide-to-coax transition is required to interface the waveguide to the antenna. Such a transition is ordinarily sensitive to the polarization of the signal propagating in the waveguide. Due to the circular symmetry of circular waveguide, slight deformation of the circular shape readily causes changes in the plane polarization of the signal propagating therethrough. Such deformations of shape take place due to motion of the tower under the influence of wind and even under conditions of thermal stress which occur, for example, when the sun rises and heats portions of the tower preferentially. Changes in polarization of the signals arriving at the waveguide-to-coax transition can cause substantial portions of the signal arriving at the transition to be reflected. The reflected signal is not radiated, and therefore the efficiency of the broadcasting system decreases. Furthermore, the reflected signal returns to the signal source and may substantially increase the peak voltages which the signal source must withstand. Consequently, the possibility of such reflections requires that the components of the signal source be designed or rated to withstand the higher voltage stress, which increases the cost. Furthermore, the increased voltage stress decreases the reliability of the signal source and of the broadcasting system generally. The reflected signal may also interact with the signal source in such a way as to cause distortion of the transmitted signal.

The polarization rotation attributable to the use of circular waveguide may be avoided by the use of rectangular waveguide, as known in the art. However, rectangular waveguide is physically asymmetrical and presents broad flat faces to winds arriving from certain directions. Because of gain requirements imposed on the transmitting antenna, there are limitations on its beamwidth which require that the tower movement be restricted in order to prevent large-amplitude signal variation at the receiver. When rectangular waveguide is used, therefore, the tower must be substantially more rigid than would be the case for use with circular waveguide. Increased rigidity adds to the weight and cost of the tower.

In accordance with the invention, at least a portion of the waveguide 530 extending the length of the tower is truncated circular waveguide as described in conjunction with FIGS. 1–4. The truncated circular waveguide maintains polarization notwithstanding deformation due to flexure much as does rectangular waveguide, and furthermore has wind loading which is substantially less than that of equivalent rectangular waveguide.

FIG. 6 illustrates, in perspective view and partially cut away, a transition between a coaxial transmission line and truncated circular waveguide using an electric probe. Such a transition may be used at the base of tower 512 of FIG. 5 is transmission line section 532 is coaxial, and may be used at the top of tower 512 to couple signal from truncated circular waveguide 530 to the coaxial input of antenna 524. In FIG. 6, the coaxial transmission line section is designated generally as 610 and includes a cylindrical outer conductor 612 and coaxial inner conductor 614. Outer conductor 612 is coupled to an aperture 616 in the middle of plate 618. A second conductive plate 620 separated from and parallel to plate 618, and conductive arcuate walls 622 and 624 together define a portion of a truncated circular waveguide 626. A probe or extension 628 of center conductor 614 extends past aperture 616 into the interior of truncated circular waveguide 626. A short-circuiting wall 630 closes off truncated circular waveguide 626 at a point approximately one quarter wavelengthh at the frequency of operation away from probe 628. The mode of operation of the transition of FIG. 6 is similar to that of corresponding transitions for rectangular and circular waveguides, and will be clear to those skilled in the art without further explanation.

Figure 8:
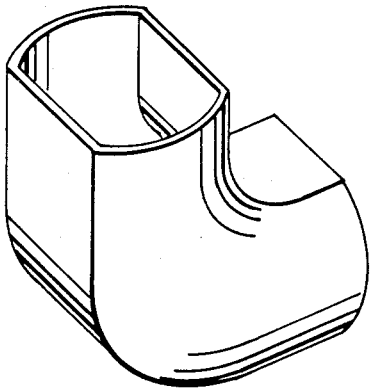
FIG. 8 is a perspective view of a truncated circular waveguide bend which may be used in the arrangement of FIG. 5.

If the run between signal source 510 of FIG. 5 and the base of tower 512 is long, it may be desired to use waveguide for transmission line portion 532. When transmission line portion 532 is rectangular waveguide and transmission line portion 530 is truncated circular waveguide, bend 533 in FIG. 5 may be a standard rectangular waveguide E-plane bend. FIG. *7a* illustrates a rectangular-to-truncated-circular waveguide transition suitable for use as a transition between a rectangular waveguide port of bennd 533 and the truncated circular waveguide portion of transmission line 530. In FIG. *7a*, 710 designates generally an elongated tapered transition. Transition 710 includes flat top and bottom walls 712 and 714, respectively. Transition 710 also includes a pair of spaced apaprt side walls 716 and 718 which form a rectangular waveguide port 720 adapted to be coupled to a further section of rectangular waveguide (not illustrated) by means such as flanges (not illustrated). Sides 716 and 718 are flat in the region of port 720 and gradually take on an arcuate configuration at the end of transition 710 remote from port 720, which arcuate configuration matches the curvature of the arcuate walls of the truncated circular waveguide, illustrated as 730, with which it mates. When mated by bolts and flanges (not illustrated) or by welding, D-shaped openings 732 and 734 may be left open. If openings 732 and 734 are downwardly facing, ingress of foreign matter is unlikely. However, it may be desirable to close apertures 732 and 734, for which purpose D-shaped plates 736 and 738 may be welded or otherwise fastened thereover. FIG. *7b* illustrates a cross section of transition 710 along section lines *7b—7b* of FIG. *7a*. The truncated circular waveguide port may as illustrated have a diameter slighly less than the long dimension of the rectangular waveguide port, or it may be of the same size or larger. FIG. 8 illustrates an E-plane bend which may be used as required with transmission line 530 of FIG. 5.

In order to reduce the weight of the waveguide run or for other reasons, it may be desirable to make waveguide run 530 of FIG. 5 from a waveguide in which the signal carrying channel (flat plates 14 and 16, and arcuate portions 42 and 44 of FIG. *2b*) is formed from a conductive material such as metal, and in which the arcuate portions (46, 48 of FIG. *2b*) subtended by the flat plates are shrouds formed from a lightweight material such as a nonconductive reinforced plastic material (i.e. fiber glass reinforced epoxy).

Figure 9:
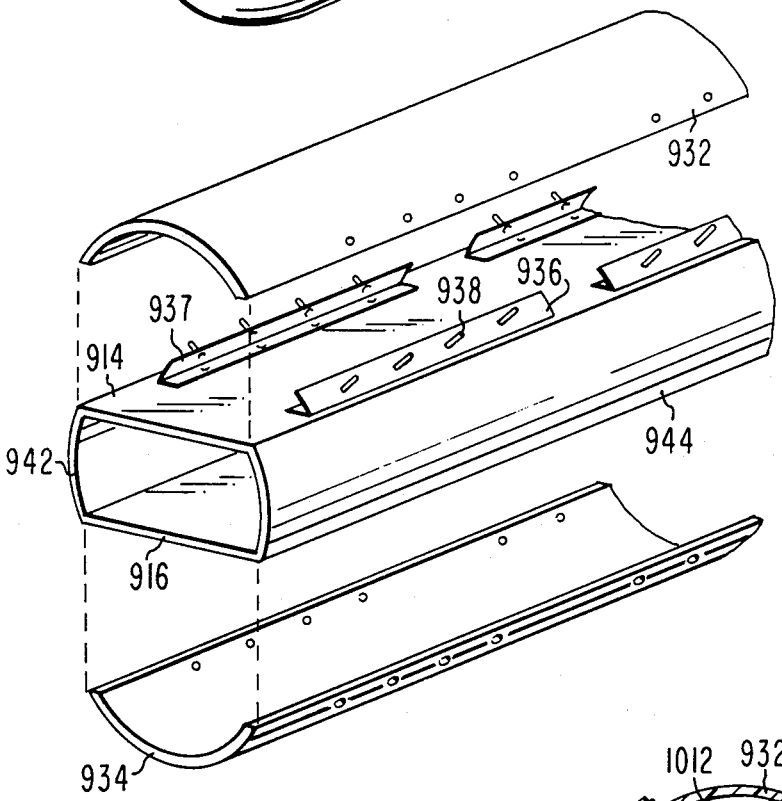
FIG. 9 illustrates in exploded perspective view of a portion of truncated circular waveguide in which a nonconductive shroud is substituted for a portion of the conductive outer walls.

FIG. 9 illustrates a section of waveguide provided with such a nonconductive shroud, In FIG. 9, flat upper and lower walls 914 and 916, and arcuate side walls 942 and 944 are formed from conductive metal. Shrouds 932 and 934 have an arcuate shape which matches the arcuate configuration of walls 942 and 944 so that, when assembled, the external configuration is circular. Shrouds 932 and 934 are made from glass fiber reinforced epoxy. Shrouds 932 and 934 are held in place by brackets, one of which is designated 936, which are riveted or otherwise fastened to top wall 914. Bracket 936 includes a plurality of captivated threaded studs, one of which is designated 938. When assembled, each of the studs protrudes through a corresponding aperture along the edge of the shroud, and a nut and washer threaded onto each stud holds the shroud firmly in position.

Figure 10:
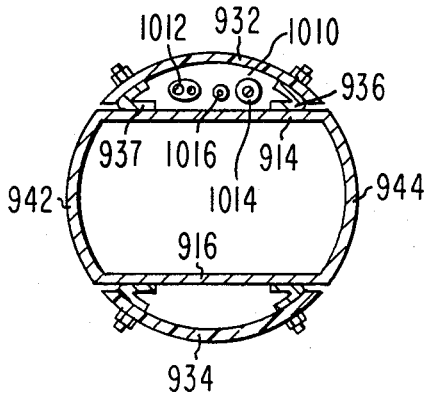

Broadcast antenna systems such as that illustrated in FIG. 5 often require lights on the tower and electrical resistance deicers. The electrical conductors which supply power for such uses, and other conductors for local communications and monitoring, must extend along the tower. Such conductors are ordinarily fastened to the exterior of the tower or to the exterior of the waveguide. In such a position, they increase the windload. FIG. 10 illustrates a cross section of the waveguide of FIG. 9 illustrating auxiliary conductors running within a channel defined by the exterior of a flat conductive plate and shroud. In FIG. 10, elements corresponding to those of FIG. 9 are designated by the same reference numeral. As illustrated in FIG. 10, a D-shaped channel designated generally as 1010 is defined by flat conductive plate 914 and shroud 932. Within channel 1010 pass a pair of insulated conductors illustrated as 1012 to provide power for tower warning lights, a single insulated conductor 104 which supplies power to one end of a deicing resistor (not illustrated) which has as its return path the metallic structure of the tower itself, and a coaxial cable illustrated as 1016 for local tower communications.

Figure 11A:
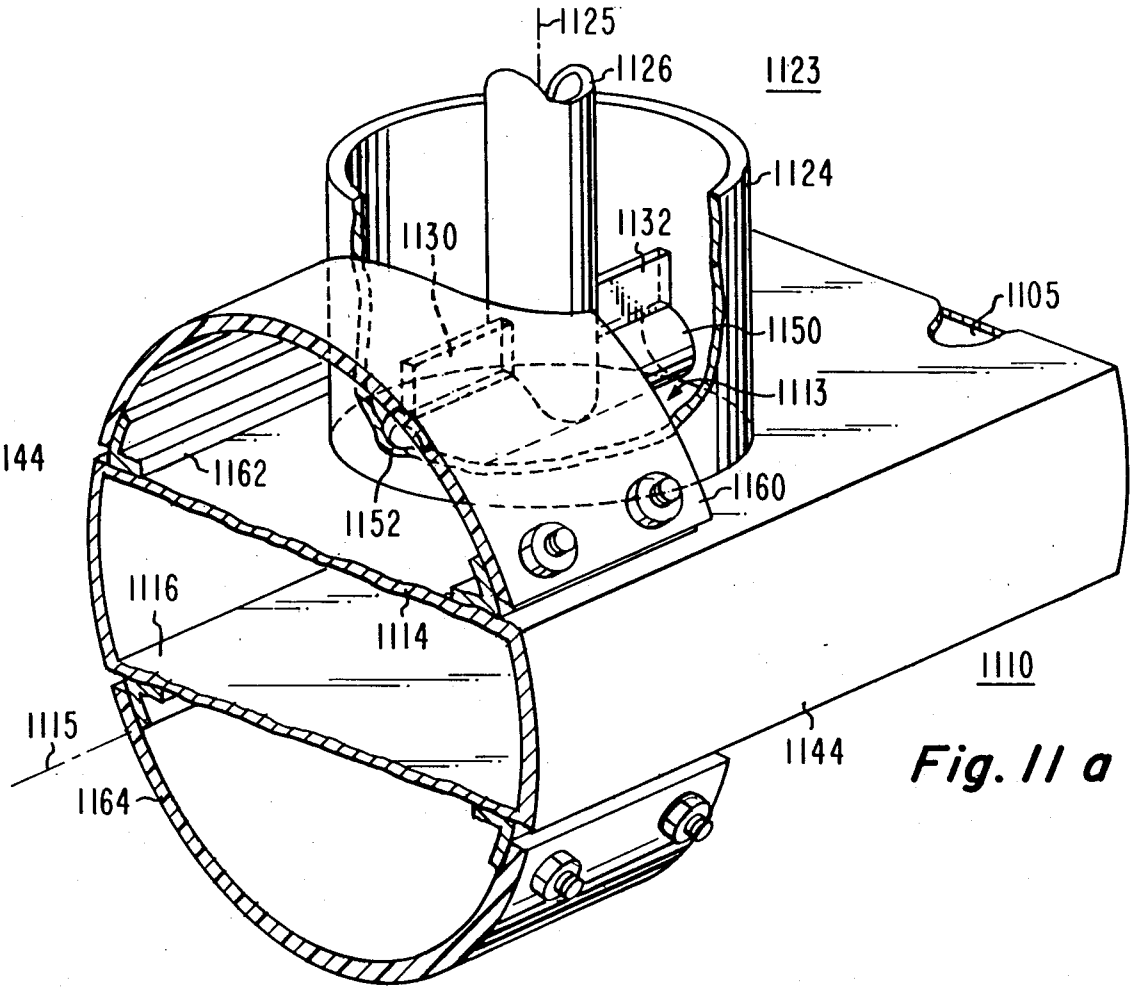
FIG. 11*a* is a view of another embodiment of a coax-to-truncated-circular-waveguide transition.

FIG. 11*a* illustrates in cutaway perspective view a truncated circular waveguide-to-coax transition similar to the transition described in a U.S. patent application entitled "TV Broadcast System With Mode-Controlling Waveguide-to-Coax Transition" filed Aug. 28, 1984, in the name of Raymond N. Clark and designated by Ser. No. 655,529. In FIG. 11*a*, flat spaced conductive walls 1114 and 1116 and arcuate conductive walls 1142 and 1144 centered on an axis 1115 define the signal carrying portion of a truncated circular waveguide. An aperture 1113 centered in upper conductive plate 1114 has its edge connected to the outer conductor 1124 of a coaxial transmission line 1123 having an axis 1125. A conductive tube 1150 extends diametrically across and connects to the inside surface of outer conductor 1124. A lower edge of conductive tube 1150 is substantially even with the inside surface of top plate 1114. The axis of tube 1150 is parallel to axis 1115. A hollow center conductor 1126 extends within and coaxial with outer conductor 1124 and intersects the center of tube 1150. A pair of mode suppressing conductive plates 1130 and 1132 lie in a plane define by both waveguide central axis 1115 and coax axis 1125. A plate 1105 orthogonal to axis 1115 closes off the waveguide by short-circuiting upper and lower walls 1114 annd 1116, and arcuate walls 1142 and 1144 at a location approximately one quarter wavelength at the frequency of operation from axis 1125. A bracket 1162 is part of a fastening arrangement for holding a shroud 1160 onto flat plate 1114. Corresponding fastening arrangements (not illustrated) hold a shroud 1164 to lower plate 1116.

Figure 11B:
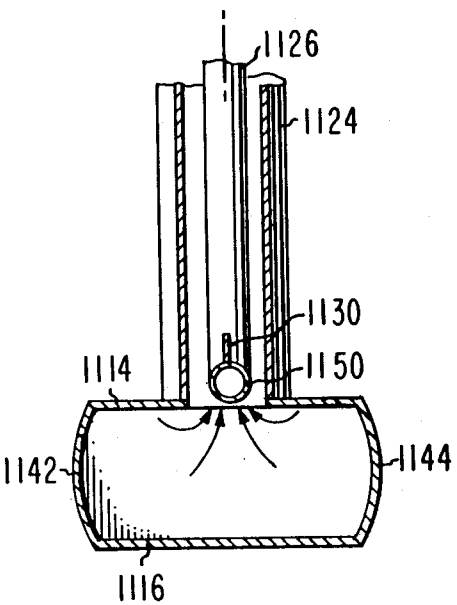
FIG. 11*b* is a sectional view aiding in understanding its operation.

FIG. 11*b* is a simplified cross sectional view of transition 1110 taken in a plane which passes through plate 1130 and which is orthogonal to axis 1115. FIG. 11*b* illustrates as arrows the electrical field configuration at aperture 1113. It can be seen that the electric field includes mutually opposed components of substantially equal magnitude, which tends to reduce the magnitude of undesired $TE_{1,1}$ modes and of other undesirable modes which may be propagated within coaxial transmission line 1123 when its dimensions are large.

Other embodiments of the invention will be apparent to those skilled in the art. For example, the truncated circular waveguide may run through the interior of the tower rather than outside the tower as illustrated in FIG. 5. Shrouds 932 and 932 of FIG. 9 may be conductive if desired. Conductors may run beneath both shrouds rather than through one.

What is claimed is:

1. A process of fabricating a waveguide comprising the steps of:

forming an internal waveguide element including (1) two spaced flat metal plates having right and left longitudinal edges annd (2) two spaced arcuate metal plates, each joined at its opposite ends to the two same right and left longitudinal edges respectively of the flat metal plates;

thereafter attaching a separate, external circumferential member to the thus-formed internal waveguide element so as to provide an external circular cross-sectional configuration for the waveguide.

2. A process of fabricating a waveguide as defined in claim 1, including forming said circumferential member to comprise two individual shrouds attached so as to be respectively subtended by said two spaced flat metal plates.

3. A process as defined in claim 2, in which said shrouds are constituted of glass fiber reinforced epoxy.

* * * * *